US010086307B2

(12) United States Patent
Duda, III et al.

(10) Patent No.: US 10,086,307 B2
(45) Date of Patent: Oct. 2, 2018

(54) FISHING TOY

(71) Applicant: Anything Possible, LLC, Jacksonville, AR (US)

(72) Inventors: Ralph Joseph Duda, III, Battlefield, MO (US); Van Blakely, Sherwood, AR (US); Jason Bauer, Jacksonville, AR (US); Anthony Tolliver, Minneapolis, MN (US)

(73) Assignee: Anything Possible, LLC, Jacksonville, AR (US)

( * ) Notice: Subject to any disclaimer, the term of this patent is extended or adjusted under 35 U.S.C. 154(b) by 4 days.

(21) Appl. No.: 14/090,537

(22) Filed: Nov. 26, 2013

(65) Prior Publication Data

US 2014/0162526 A1 Jun. 12, 2014

Related U.S. Application Data

(63) Continuation-in-part of application No. 13/850,326, filed on Mar. 26, 2013, now abandoned, which is a continuation-in-part of application No. 13/708,962, filed on Dec. 8, 2012, now abandoned.

(51) Int. Cl.
*A63H 23/10* (2006.01)
*A63H 37/00* (2006.01)

(52) U.S. Cl.
CPC ..... *A63H 23/10* (2013.01); *A63H 37/00* (2013.01)

(58) Field of Classification Search
CPC . A63H 23/10; A63H 33/00; A63F 2250/0407; A63F 9/305
See application file for complete search history.

(56) References Cited

U.S. PATENT DOCUMENTS 484,950 A * 10/1892 Dungey ..... A63H 33/26 273/140
994,927 A * 6/1911 Jefferson ..... A01K 85/02 43/42.1
2,158,924 A * 5/1939 Bouton ..... A01K 85/16 43/42.1
2,329,117 A * 9/1943 Henderson et al. ..... 43/43.12
2,509,785 A * 5/1950 Rubin ..... 446/139
2,633,660 A * 4/1953 Ray ..... A01K 85/08 43/42.27
2,914,883 A * 12/1959 Kustusch ..... 43/41.2
2,983,065 A * 5/1961 Ferguson ..... A01K 85/01 43/42.06
2,994,983 A * 8/1961 Best ..... A01K 85/16 43/41
3,032,911 A * 5/1962 Wilhelmi ..... A01K 85/08 43/42.27

(Continued)

*Primary Examiner* — Melba Bumgarner
*Assistant Examiner* — Amir Klayman
(74) *Attorney, Agent, or Firm* — Kutak Rock LLP; James H. Jeffries

(57) ABSTRACT

The present invention provides a fishing toy comprising a bait head resembling a fishing lure attached to a sponge resembling an aquatic animal. The sponge is initially compressed and rolled such that it fits inside a dissolving gel capsule or paper pouch encapsulation. During play, the entire bait unit is submerged into water. Once exposed to water, the capsule dissolves, releasing the captive animal-shaped sponge. The increase of weight and drag on the line simulates a live fishing experience.

5 Claims, 6 Drawing Sheets

(56) References Cited

U.S. PATENT DOCUMENTS

| | | | | | |
|---|---|---|---|---|---|
| 3,066,434 | A | * | 12/1962 | Duller | A01K 85/01 43/42.06 |
| 3,680,250 | A | | 8/1972 | Hetrick et al. | |
| 3,835,572 | A | * | 9/1974 | Mounsey | A01K 85/16 43/42.06 |
| 4,881,915 | A | | 11/1989 | Liaw | |
| 5,086,581 | A | | 2/1992 | Barra | |
| 5,273,476 | A | | 12/1993 | Darfman | |
| 5,299,378 | A | * | 4/1994 | Ballard | A01K 85/00 43/42.06 |
| 5,522,755 | A | | 6/1996 | Farrell et al. | |
| 6,022,025 | A | | 2/2000 | Chuang | |
| 6,575,807 | B2 | | 6/2003 | Spector | |
| 6,581,319 | B2 | | 6/2003 | West | |
| 6,668,482 | B1 | * | 12/2003 | Ruffin | A01K 85/01 43/42.06 |
| 2004/0068916 | A1 | * | 4/2004 | Harris | A01K 97/02 43/44.99 |
| 2011/0047856 | A1 | * | 3/2011 | Gustafsson | A01K 85/00 43/42.02 |
| 2013/0031822 | A1 | * | 2/2013 | Reeves | A01K 85/00 43/42.06 |

* cited by examiner

FISHING TOY

RELATED APPLICATIONS

This application is a continuation in part of U.S. patent application Ser. No. 13,850,326 filed Mar. 26, 2013 which is a continuation in part of U.S. patent application Ser. No. 13,708,962 filed Dec. 8, 2012. Both applications are hereby fully incorporated by reference in their entirety.

FIELD

The present invention relates to a fishing toy that simulates a real fishing experience. More particularly, the invention relates to a fishing toy that includes a reusable plastic head for connection to a standard fishing line, a fish-shaped sponge body attached to the head and a printed paper wrapper encapsulating the sponge body. When deployed into water, the paper wrapper dissolves and the sponge body absorbs the water which exponentially increases the weight, and therefore the resistance, of the toy within the water. This increased weight and resistance creates a realistic feel as the user reels in their catch.

BACKGROUND

Fishing toys are well known in the art, however, such toys are not intended to simulate a realistic fishing experience. Many such toys include fish, often manufactured from plastic, that are used as casting baits to train new anglers how to cast fishing line.

Other fishing toys might use a magnet on a fishing line to "catch" a magnet on a plastic fish. One such example of a fishing toy comprises motor driven fish that simulates a swimming fish. A magnetic bait is provided on fishing line and a mated magnet is provided on the toy fish. The toy fish can mechanically swims in the water with the lower jaw slowly opens and closes. When a magnetic bait attracts and attaches to the magnet on the fish a bite triggering mechanism is actuated and the fish tail and the lower jaw swing more violently so as to create a live effect similar to the effect experienced when catching a real fish. However, the aforementioned toy does not provide a realistic baiting experience simulating the process of attaching a lure to the distal end of a line. Additionally, the success of the aforementioned toy is subject to the physical interaction of the magnetic bait with magnetic trigger mechanism, the chance of which decreases as the area of play increases. This limits such a toy from being used with success in a large body of water such as a pool, lake, or river. Moreover, these types of toys are very expensive to manufacture, are prone to failure during use and are difficult to operate.

SUMMARY

The present invention provides a fishing toy that is simple to use, extremely fun for the user, and provides realistic fishing simulation in any aqueous environment. It can be used indoors or outside and is safe for use by very young and inexperienced anglers.

The inventive fishing toy includes a bait head resembling a fishing lure that further includes a loop for attaching a fishing line and a clasp for attaching the head to a compressed sponge that is configured to resemble an aquatic animal when deployed. The sponge is initially compressed and rolled such that it fits inside a dissolving capsule. The compressed sponge is attached to the bait head by means of a clasp mechanism that interfaces with a hole in the sponge. A ring on the bait head allows attachment to a hook or line. During play, the entire bait unit is submerged into water. In one configuration, the bait head provides lateral channels that channel fluid entry into the interior of the capsule. Additionally, the capsule may have perforations that aid fluid entry. Once exposed to water, the capsule itself dissolves, releasing the captive animal-shaped sponge. The sponge is retained on the bait head via the clasp mechanism. The increase of weight and drag on the line simulates a live fishing experience as the angler reels in the fish. Thereby, as the fishing toy is introduced to water the animal shape is generated from the growth of the bait unit into the uncompressed sponge.

A second embodiment of the invention replaces the capsule described above with a water soluble paper pouch encapsulation. Water soluble paper can be printed on, and dissolves rapidly in water. The compressed sponge is attached to the bait head by means of the clasp mechanism that interfaces with a hole in the sponge. Once exposed to water, the water soluble paper dissolves rapidly, preferably between 3 and 10 seconds, releasing the captive animal-shaped sponge. The increase of weight and drag on the line simulates a live fishing experience. Thereby, as the fishing toy is introduced to water the animal shape is generated from the growth of the bait unit into the uncompressed sponge.

After the initial use of the toy, the user can use the sponge animal as a plug for casting practice. The bait head portion of the toy can also be reused by fastening replacement encapsulated sponge animals thereto.

The sponge animal can be configured in any shape, however, it is preferred that the animal represent a variety of fresh water and salt water animals to provide the user with a variety of fishing experiences. It is also understood that the fishing toy can be presented in any size so that it can be mated to a variety of fishing equipment. While the toy is intended for novice anglers, it is readily adaptable to full sized fishing equipment. The capsule containing the sponge animal can be decorated with the image of the sponge animal or any other decoration.

The various objects and advantages of the present invention will be more readily understood from the following detailed description when read in conjunction with the appended drawings.

DETAILED DESCRIPTION

Figure 1:
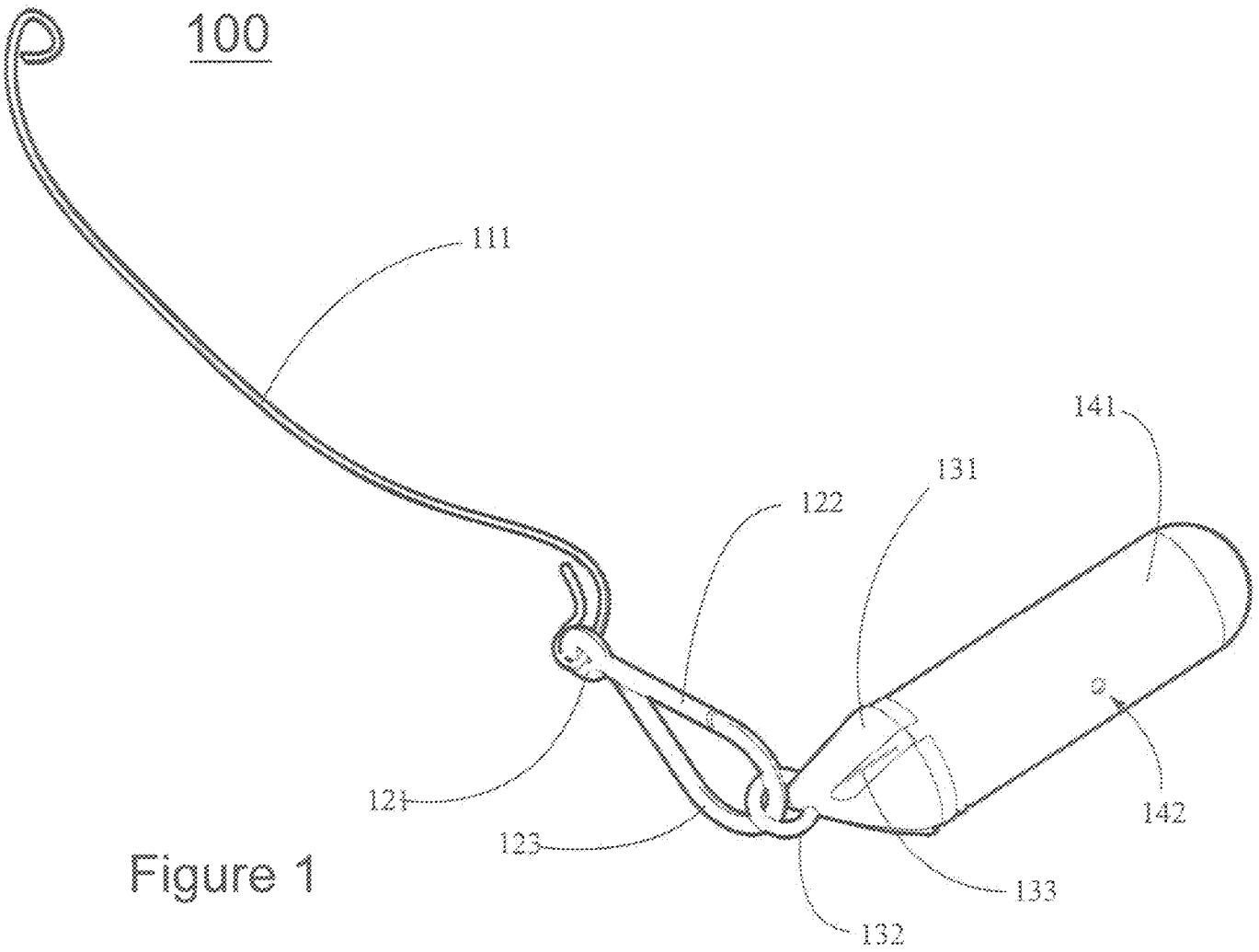
FIG. 1 is an perspective view of a first embodiment of a fishing toy according to the present invention.
Figure 2:
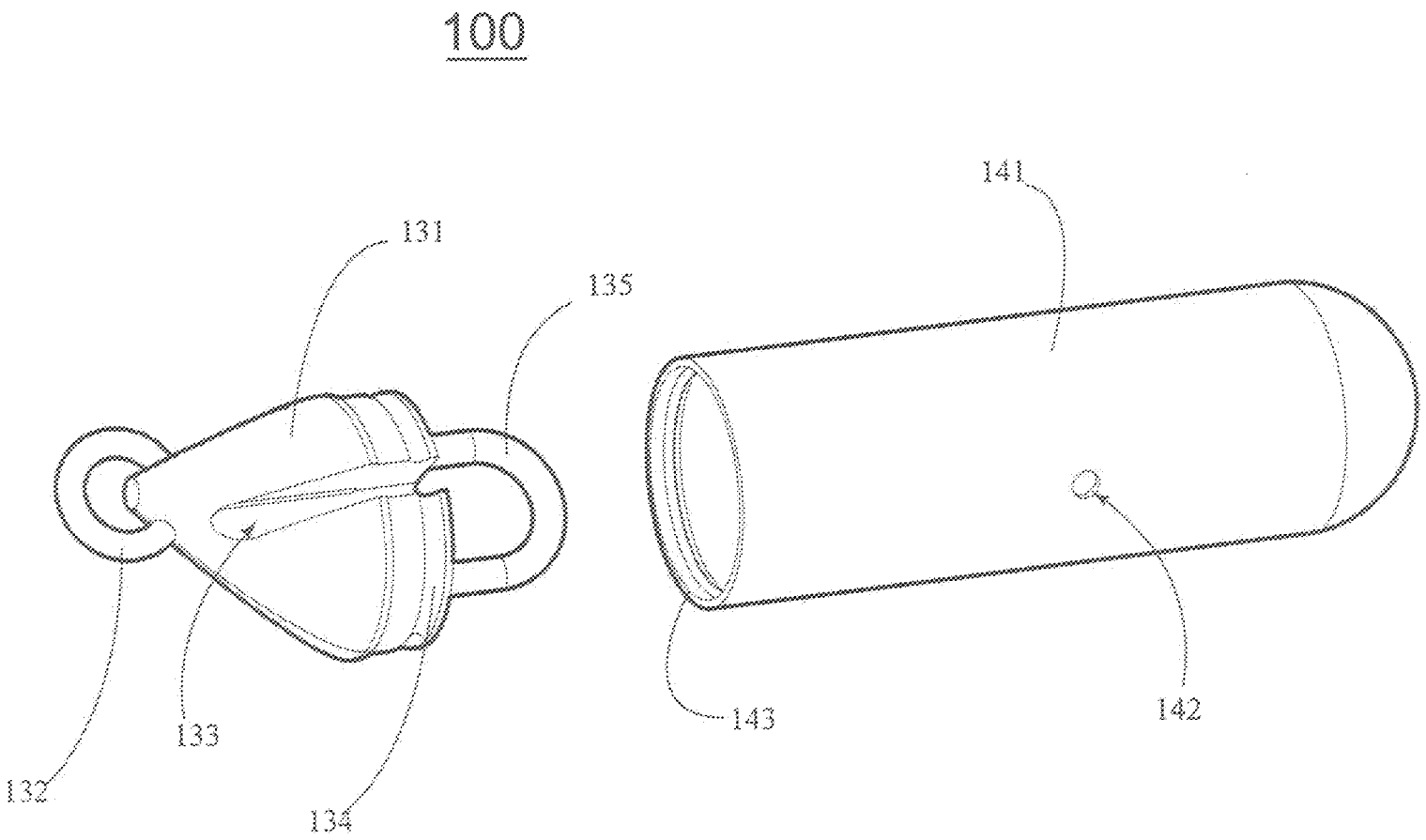
FIG. 2 is a partial exploded view of the fishing toy shown in FIG. 1.
Figure 3:
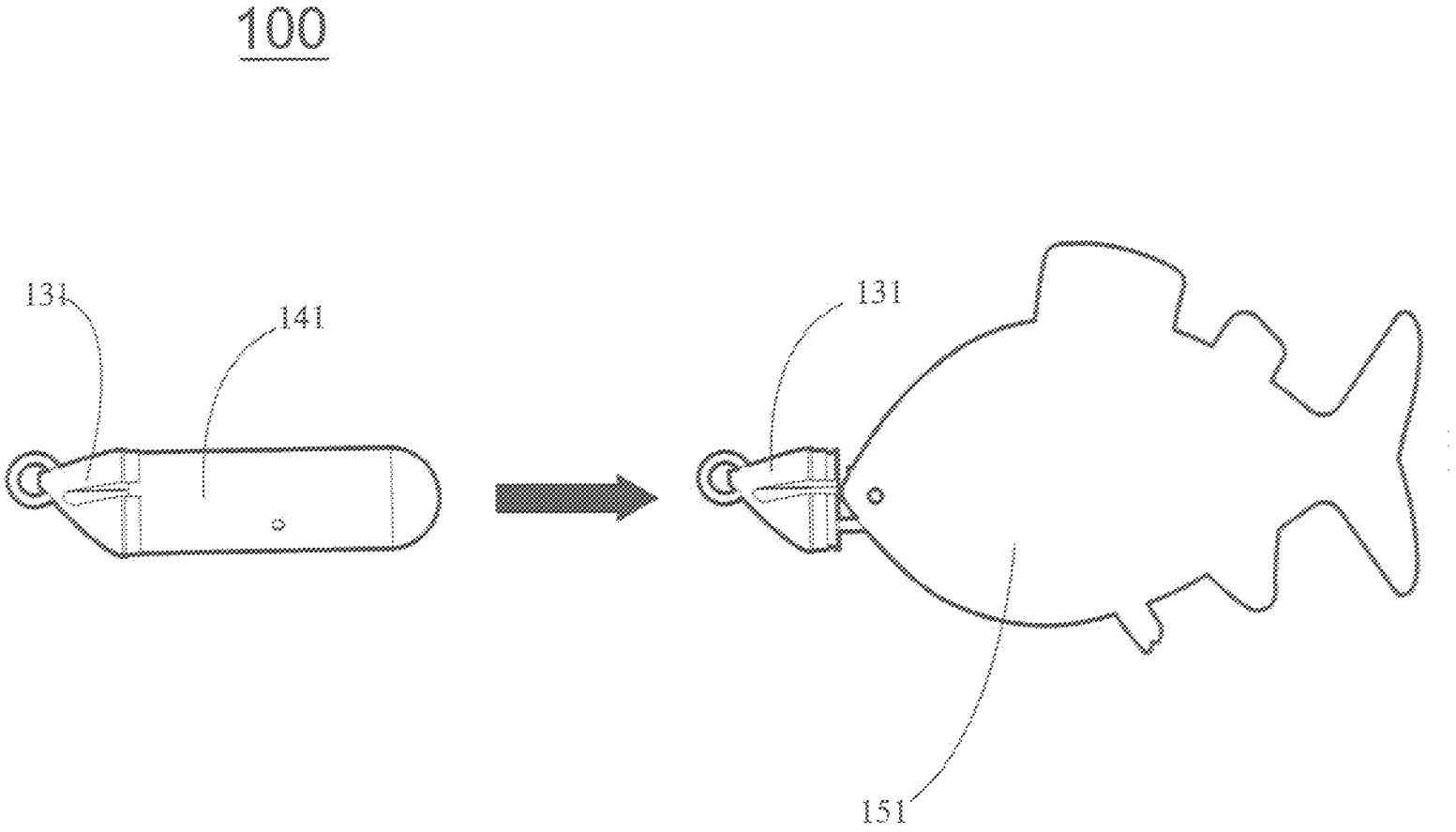
FIG. 3 is a side view showing the transformation of the fishing toy shown in FIG. 1.

Referring generally to FIGS. 1-3, a first embodiment of a fishing toy according to the present invention includes a bait head 131, a sponge animal 151, a capsule body 141 and a fastening mechanism or hook 122 for connection to a fishing line 111. One end of the bait head 131 terminates in an eyelet, or exterior fastening mechanism, 132 allowing for attachment to hook 122. Hook 122 provides an eyelet 121 allowing for attachment to line 111, the distal end of which may be attached to a conventional fishing pole or rod. The opposite end of bait head 131 includes a first fastening mechanism 134 which provides a direct physical interface with a second fastening mechanism 143 on the capsule body 141. Bait head 131 may be of any diameter such that it interfaces with capsule body 141.

Bait head 131 also includes an interior fastening device 135 that allows attachment of the sponge animal 151. The interior fastening device 135 can be any mechanical connector suitable for fastening and securement of the sponge animal 151, such as a loop, a spike, a threaded spike or hook. Sponge animal 151 may be of any size such that it allows for successful attachment to bait head 131. Sponge animal 151 is initially compressed such that the entirety of its volume fits into the interior volume of capsule body 141. Sponge animal 151 shall be of a size such that it in no way interferes with the successful attachment of first fastening mechanism 134 on bait head 131 with the second fastening mechanism 143 on capsule body 141.

When the entire assembly is submerged in water, at least one channel 133 on bait head 131 and at least one perforation 142 on capsule body 141 provide a means for water to enter capsule body 141. The at least one channel 133 on the bait head 131 may forcibly direct water into the capsule body 141 as the toy is pulled through the water. In this embodiment, the capsule body 141 will be made from a material for which water acts as a dissolving agent, resulting in the total decomposition of capsule body 141 in an aqueous environment. Capsules made from dissolving materials such as gelatin are well known and find a wide array of uses, such as in the pharmaceutical industry. It is understood that the capsule body of the instant invention can be manufactured from any material that is substantially solid when dry and which dissolves when subjected to liquid. As the capsule material dissolves, the sponge animal 151 is released. The expansion of the sponge animal 151 as the capsule 141 dissolves aids in the capsule 141 being shed from the bait head 131.

Thus, introduction to water results in the dissolution of capsule body 141, thereby releasing sponge animal 151 from its compressed state as represented in FIG. 3. Sponge animal 151 will be composed of a material that absorbs water and in doing so expands to its uncompressed state. This sudden increase in the surface area presented by sponge animal 151 will increase drag and provide realistic weight at the end of line 111, simulating a real fishing experience and providing toy user with the opportunity to collect sponge animal 151. The sponge animal 151 can be configured in any shape, however, it is preferred that the animal represent a variety of fresh water and salt water animals to provide the user with a variety of fishing experiences. It is also understood that the fishing toy can be presented in any size so that it can be mated to a variety of fishing equipment.

Figure 4:
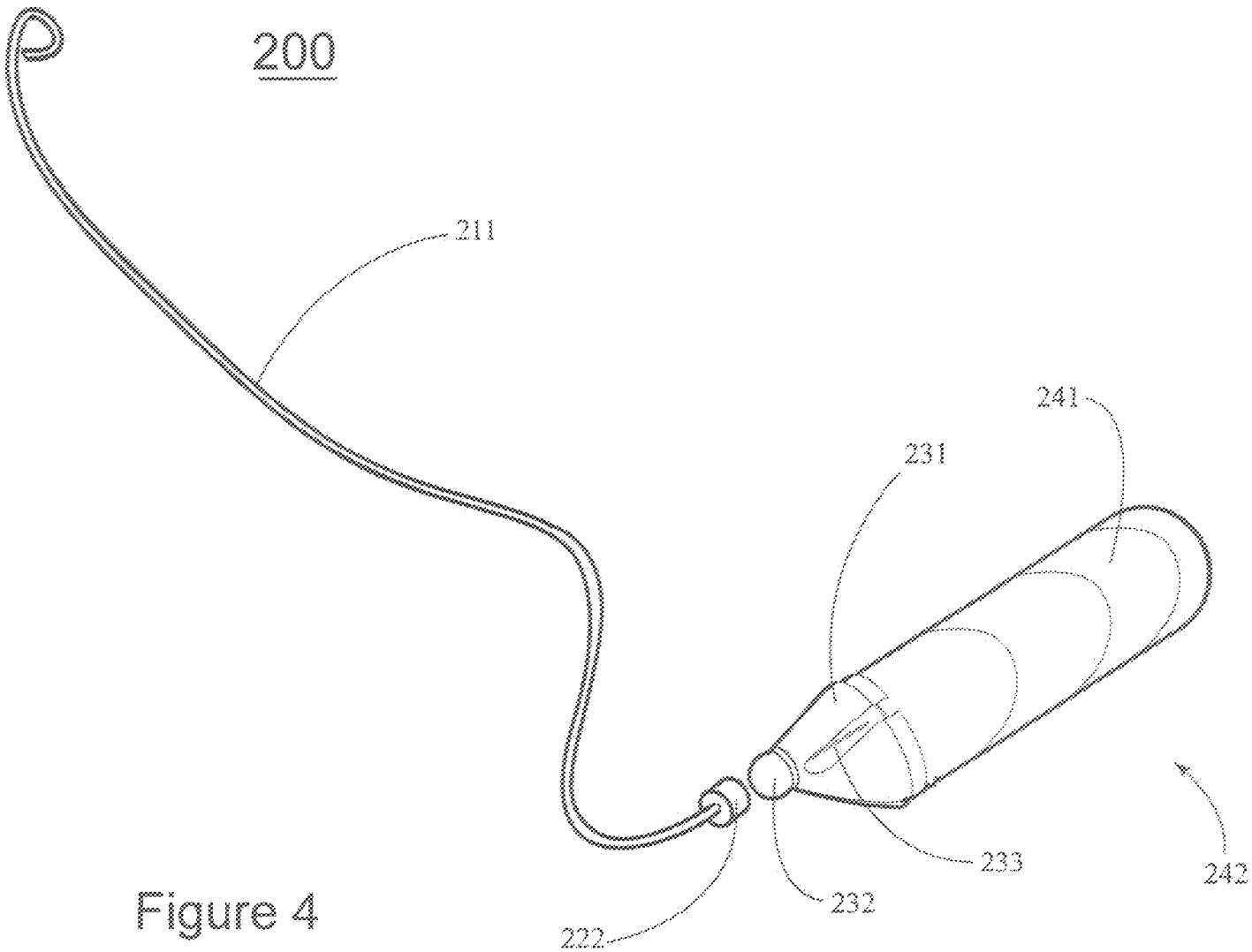
FIG. 4 is a perspective view of another embodiment of a fishing toy according to the present invention.
Figure 5:
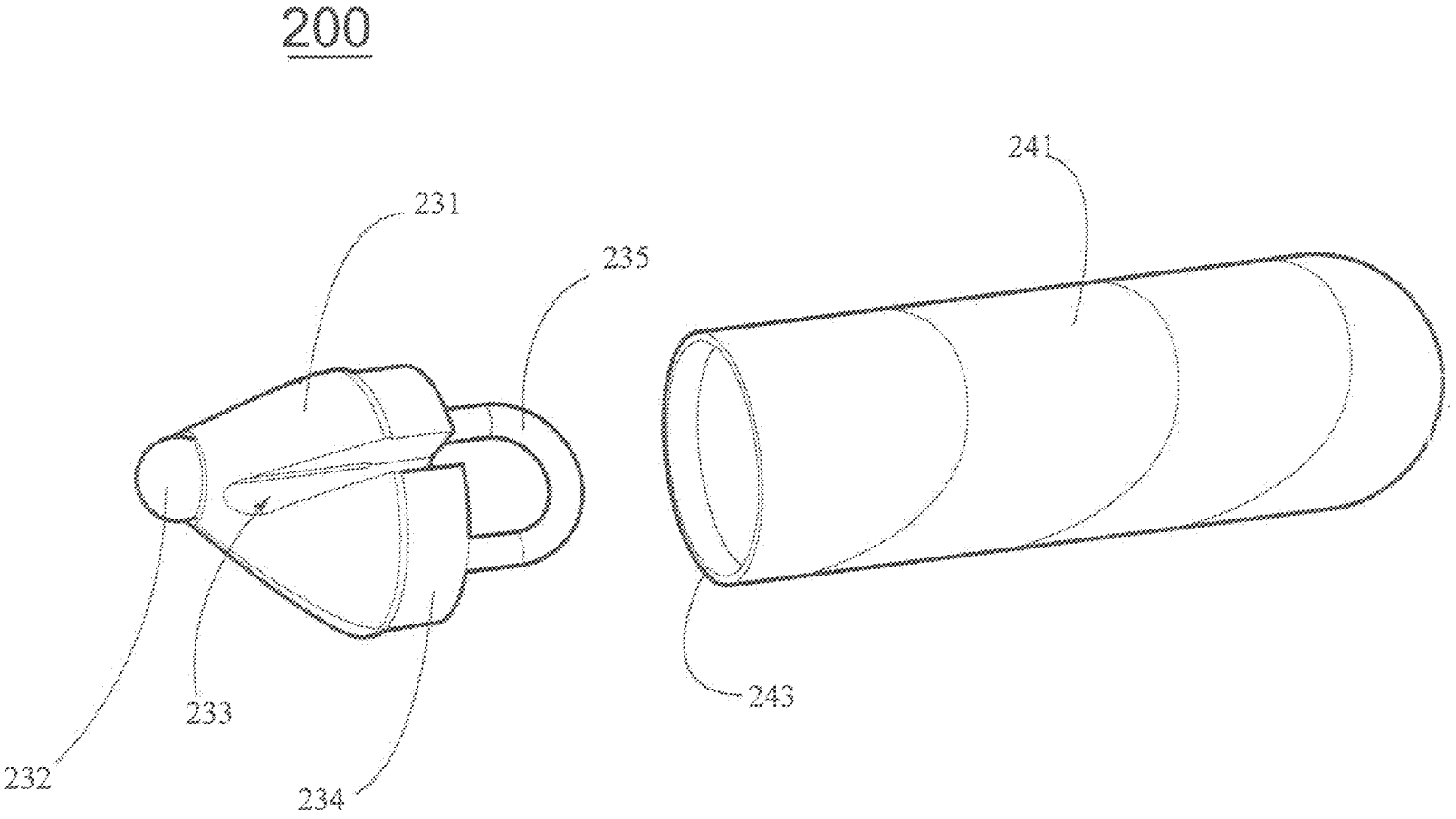
FIG. 5 is an partial exploded view of the fishing toy shown in FIG. 4.
Figure 6:
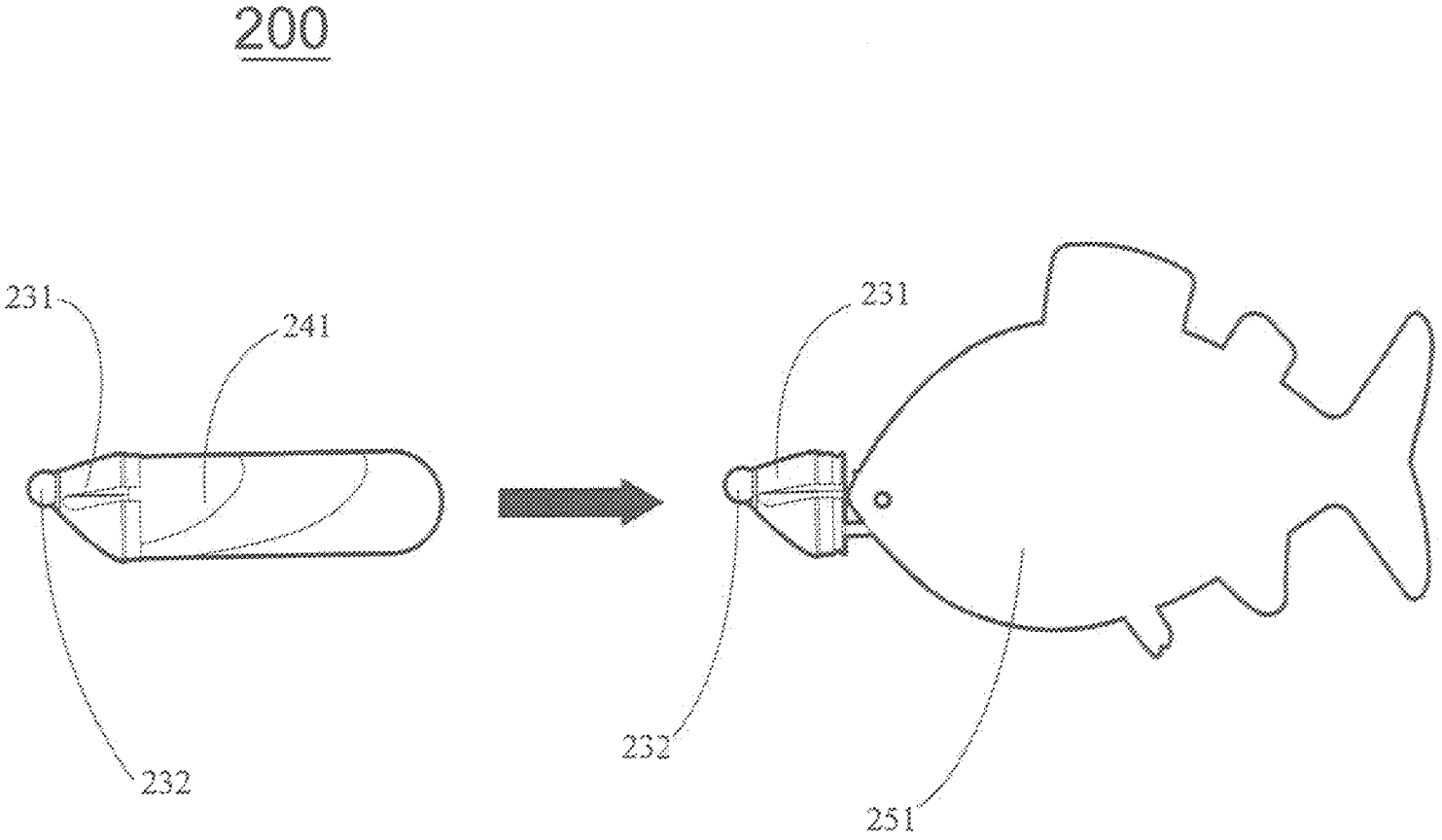
FIG. 6 is a side view showing the transformation of the fishing toy shown in FIG. 4.

Referring generally now to FIGS. 4-6, the preferred embodiment of a fishing toy according to the present invention includes a bait head 231, a sponge animal 251, a water soluble paper pouch encapsulation 241, a first fastening mechanism or hook 222 for connection to a standard fishing line 211. One end of the bait head 231 includes a connector 232 allowing for attachment to hook 222. The connector 232 can be a loop or clip integral the bait head 231 such as those commonly found on artificial fishing lures, Alternatively, the connector 232 can be presented as a magnetic connector with a metal stud formed a ferrous metal encapsulated in a material that does not corrode in water, such as a thermoplastic or thermal set polymer. Any magnetically attractive material may be employed to achieve the aspect of the metal stud. In this iteration, the connector 222 is a magnetic member which provides a magnetic means of attachment to the metal stud 232 of the bait head 231. The opposite end of bait head 231 includes a second connector 234 which provides a direct physical interface with a fastening region 243 of the paper pouch encapsulation 241. Bait head 231 may be of any diameter such that it interfaces with paper pouch encapsulation 241. Any combination of adhesives or mechanical engagement may be used to join the paper pouch encapsulation 241 to the bait head 231.

Sponge animal 251 may be of any size such that it allows for successful attachment to bait head 231. Sponge animal 251 is initially compressed such that the entirety of its volume fits into the interior volume of paper pouch encapsulation 241.

Sponge animal 251 shall be of a size such that it in no way interferes with the successful attachment of fastening mechanism 234 on bait head 231 with fastening mechanism 243 on paper pouch encapsulation 241.

When the entire assembly is submerged in water, at least one channel 233 on bait head 231 provides a means for water to enter the paper pouch encapsulation 241. Paper pouch encapsulation 241 will be composed of a material for which water acts as a dissolving agent, resulting in rapid and total decomposition of paper pouch encapsulation 241 when subjected to an aqueous environment. Thus, introduction to such an environment results in the dissolution of paper pouch encapsulation 241, thereby releasing sponge animal 251 from its compressed state. Sponge animal 251 will be composed of a material that rapidly absorbs water and in doing so expands to its uncompressed state. This sudden increase in the surface area presented by sponge animal 251 will increase drag and provide realistic weight at the end of line 211, simulating a real fishing experience and providing toy user with the opportunity to collect sponge animal 251.

Water soluble papers are known and used in numerous applications, although never for fishing toys. The solubility of paper can be regulated during the manufacturing process such that the paper degrades over a predetermined time when subjected to a target liquid. For the instant application, water soluble paper that degrades over a relatively short period of time is preferred, and such paper degradation rate can easily be controlled. It is preferred that the paper pouch encapsulation 251 be manufactured from a paper that is substantially degraded in water over a period of time from between one and 120 seconds. More preferable is a paper that substantially degrades in water over a period of time from between approximately one second and approximately 30 seconds.

Through the above description, it should now become readily apparent how and why the present invention can achieve the object it contemplates. It is also to be understood that the above disclosed embodiment is illustrative but not limited.

What is claimed is:

1. A fishing toy for attachment to a fishing line, the fishing toy comprising:

a bait head having a first end with an exterior fastening mechanism and a second end having an interior fastening mechanism and a first fastening mechanism;

a capsule body having a closed end, an open end, and a second fastening mechanism on the capsule body adjacent to the open end thereof;

wherein the capsule body is manufactured from a water soluble material;

a compressed sponge secured to the interior fastening mechanism of the bait head and disposed within the capsule body;

wherein the exterior fastening mechanism is attached to the fishing line; and wherein the second end of the bait head is inserted into the open end of the capsule body so that the exterior fastening mechanism is disposed outside the capsule body and the interior fastening mechanism is enclosed within an interior volume of the capsule body;

wherein the second fastening mechanism of the capsule body is in direct contact with the first fastening mechanism of the bait head;

wherein the capsule body dissolves when exposed to water thereby allowing the compressed sponge to expand in size to an uncompressed state; and wherein the sponge absorbs water to increase its weight and surface area to simulate a drag and weight associated with a live fish on the fishing line.

2. The fishing toy according to claim 1 wherein the capsule body material is selected from the group consisting of: gelatin and paper.

3. The fishing toy according to claim 1 wherein the sponge is shaped like an animal.

4. The fishing toy according to claim 1 wherein at least one channel is provided on the bait head which provides a passage for water to enter into the attached capsule body.

5. The fishing toy according to claim 1 wherein the exterior fastening mechanism is a magnet that mates to a magnet provided on a fishing line.

* * * * *